US008532983B2

(12) United States Patent
Gao

(10) Patent No.: US 8,532,983 B2
(45) Date of Patent: Sep. 10, 2013

(54) ADAPTIVE FREQUENCY PREDICTION FOR ENCODING OR DECODING AN AUDIO SIGNAL

(75) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 853 days.

(21) Appl. No.: 12/554,619

(22) Filed: Sep. 4, 2009

(65) Prior Publication Data

US 2010/0063802 A1 Mar. 11, 2010

Related U.S. Application Data

(60) Provisional application No. 61/094,876, filed on Sep. 6, 2008.

(51) Int. Cl.
*G10L 19/00* (2013.01)

(52) U.S. Cl.
USPC ..... 704/201; 704/200; 704/203; 704/205; 704/500

(58) Field of Classification Search
USPC ..... 704/201, 200, 203, 205, 500
See application file for complete search history.

(56) References Cited

U.S. PATENT DOCUMENTS

| | | | |
|---|---|---|---|
| 5,828,996 | A | 10/1998 | Iijima et al. |
| 5,974,375 | A | 10/1999 | Aoyagi et al. |
| 6,018,706 | A | 1/2000 | Huang et al. |
| 6,507,814 | B1 | 1/2003 | Gao |
| 6,629,283 | B1 | 9/2003 | Toyama |
| 6,708,145 | B1 | 3/2004 | Liljeryd et al. |
| 7,216,074 | B2 | 5/2007 | Malah et al. |
| 7,328,160 | B2 | 2/2008 | Nishio et al. |
| 7,328,162 | B2 | 2/2008 | Liljeryd et al. |
| 7,359,854 | B2 | 4/2008 | Nilsson et al. |
| 7,433,817 | B2 | 10/2008 | Kjörling et al. |
| 7,447,631 | B2 | 11/2008 | Truman et al. |

(Continued)

FOREIGN PATENT DOCUMENTS

WO WO 2007/087824 A1 8/2007

OTHER PUBLICATIONS

"G.729-based embedded variable bit-rate coder: An 8-32 kbit/s scalable wideband coder bitstream interoperable with G.729," Series G: Transmission Systems and Media, Digital Systems and Networks, Digital terminal equipments—Coding of analogue signals by methods other than PCM, International Telecommunication Union, ITU-T Recommendation G.729.1 May 2006, 100 pages.

(Continued)

*Primary Examiner* — Qi Han
(74) *Attorney, Agent, or Firm* — Slater & Matsil, L.L.P.

(57) ABSTRACT

In one embodiment, a method of transceiving an audio signal is disclosed. The method includes providing low band spectral information having a plurality of spectrum coefficients and predicting a high band extended spectral fine structure from the low band spectral information for at least one subband, where the high band extended spectral fine structure are made of a plurality of spectrum coefficients. The predicting includes preparing the spectrum coefficients of the low band spectral information, defining prediction parameters for the high band extended spectral fine structure and index ranges of the prediction parameters, and determining possible best indices of the prediction parameters, where determining includes minimizing a prediction error between a reference subband in high band and a predicted subband that is selected and composed from an available low band. The possible best indices of the prediction parameters are transmitted.

23 Claims, 9 Drawing Sheets

(56) References Cited

U.S. PATENT DOCUMENTS

| | | | | |
|---|---|---|---|---|
| 7,469,206 | B2 | 12/2008 | Kjörling et al. | |
| 7,546,237 | B2 | 6/2009 | Nongpiur et al. | |
| 7,627,469 | B2 | 12/2009 | Nettre et al. | |
| 2002/0002456 | A1 | 1/2002 | Vainio et al. | |
| 2003/0093278 | A1 | 5/2003 | Malah | |
| 2003/0200092 | A1 | 10/2003 | Gao et al. | |
| 2004/0015349 | A1 | 1/2004 | Vinton et al. | |
| 2004/0181397 | A1 | 9/2004 | Gao | |
| 2004/0225505 | A1 | 11/2004 | Andersen et al. | |
| 2005/0159941 | A1 | 7/2005 | Kolesnik et al. | |
| 2005/0165603 | A1 | 7/2005 | Bessette et al. | |
| 2005/0278174 | A1 | 12/2005 | Sasaki et al. | |
| 2006/0036432 | A1 | 2/2006 | Kjorling et al. | |
| 2006/0147124 | A1 | 7/2006 | Edler et al. | |
| 2006/0271356 | A1 | 11/2006 | Vos | |
| 2007/0088558 | A1 | 4/2007 | Vos et al. | |
| 2007/0255559 | A1 | 11/2007 | Gao et al. | |
| 2007/0282603 | A1 | 12/2007 | Bessette | |
| 2007/0299662 | A1 | 12/2007 | Kim et al. | |
| 2007/0299669 | A1* | 12/2007 | Ehara | 704/262 |
| 2008/0010062 | A1* | 1/2008 | Son et al. | 704/219 |
| 2008/0027711 | A1 | 1/2008 | Rajendran et al. | |
| 2008/0052066 | A1 | 2/2008 | Oshikiri et al. | |
| 2008/0052068 | A1 | 2/2008 | Aguilar et al. | |
| 2008/0091418 | A1 | 4/2008 | Laaksonen et al. | |
| 2008/0120117 | A1 | 5/2008 | Choo et al. | |
| 2008/0126081 | A1 | 5/2008 | Geiser et al. | |
| 2008/0126086 | A1 | 5/2008 | Vos et al. | |
| 2008/0154588 | A1 | 6/2008 | Gao | |
| 2008/0195383 | A1 | 8/2008 | Shlomot et al. | |
| 2008/0208572 | A1 | 8/2008 | Nongpiur et al. | |
| 2009/0024399 | A1 | 1/2009 | Gartner et al. | |
| 2009/0125301 | A1 | 5/2009 | Master et al. | |
| 2009/0254783 | A1 | 10/2009 | Hirschfeld et al. | |
| 2010/0063803 | A1 | 3/2010 | Gao | |
| 2010/0063810 | A1 | 3/2010 | Gao | |
| 2010/0063827 | A1 | 3/2010 | Gao | |
| 2010/0070269 | A1 | 3/2010 | Gao | |
| 2010/0070270 | A1 | 3/2010 | Gao | |
| 2010/0121646 | A1* | 5/2010 | Ragot et al. | 704/500 |
| 2010/0211384 | A1 | 8/2010 | Qi et al. | |
| 2010/0292993 | A1 | 11/2010 | Vaillancourt et al. | |

OTHER PUBLICATIONS

International Search Report and Written Opinion, International application No. PCT/US2009/056106, Date of mailing Oct. 19, 2009, 11 pages.

International Search Report and Written Opinion, International Application No. PCT/US2009/056111, GH Innovation, Inc. Date of Mailing Oct. 23, 2009, 13 pages.

International Search Report and Written Opinion, International Application No. PCT/US2009/056113, Huawei Technologies Co., Ltd., Date of Mailing Oct. 22, 2009, 10 pages.

International Search Report and Written Opinion, International Application No. PCT/US2009/056117, GH Innovation, Inc., Date of Mailing Oct. 19, 2009, 8 pages.

International Search Report and Written Opinion, International Application No. PCT/US2009/056860, Huawei Technologies Co., Ltd., Inc., Date of Mailing Oct. 26, 2009, 11 page.

International Search Report and Written Opinion, International Application No. PCT/US2009/056981, GH Innovation, Inc., Date of Mailing Nov. 2, 2009, 11 pages.

* cited by examiner

ADAPTIVE FREQUENCY PREDICTION FOR ENCODING OR DECODING AN AUDIO SIGNAL

CROSS REFERENCE TO RELATED APPLICATIONS

This patent application claims priority to U.S. Provisional Application No. 61/094,876 filed on Sep. 6, 2008, entitled "Adaptive Frequency Prediction," which application is hereby incorporated by reference herein.

TECHNICAL FIELD

This invention is generally in the field of speech/audio transform coding, and more particularly related to adaptive frequency prediction.

BACKGROUND

Transform coding in frequency domain has been widely used in various ITU-T MPEG, and 3 GPP standards. If the bit rate is high enough, spectral subbands are often coded with some kinds of vector quantization (VQ) approach; if bit rate is very low, a concept of BandWidth Extension (BWE) can also be used. The VQ approach gives good quality at the cost of high bit rate, while the BWE approach requires a very low bit rate but the quality may not be adequately stable.

Similar concepts as BWE are High Band Extension (HBE), SubBand Replica, Spectral Band Replication (SBR) and High Frequency Reconstruction (HFR). Two examples of prior art BWE include Time Domain Bandwidth Extension (TDBWE), which is used in ITU-T G.729, and SBR, which is employed by the MPEG-4 audio coding standard. TDBWE works with FFT transformation and SBR usually operates in MDCT (Modified Discrete Cosine Transform) domain.

General Description of ITU G.729.1

ITU G.729.1 is also called G.729EV coder which is an 8-32 kbit/s scalable wideband (50-7000 Hz) extension of ITU-T Rec. G.729. By default, the encoder input and decoder output are sampled at 16,000 Hz. The bitstream produced by the encoder is scalable and has 12 embedded layers, which will be referred to as Layers 1 to 12. Layer 1 is the core layer corresponding to a bit rate of 8 kbit/s. This layer is compliant with the G.729 bitstream, which makes G.729EV interoperable with G.729. Layer 2 is a narrowband enhancement layer adding 4 kbit/s, while Layers 3 to 12 are wideband enhancement layers adding 20 kbit/s with steps of 2 kbit/s.

This coder is designed to operate with a digital signal sampled at 16,000 Hz followed by conversion to 16-bit linear PCM for the input to the encoder. However, the 8,000 Hz input sampling frequency is also supported. Similarly, the format of the decoder output is 16-bit linear PCM with a sampling frequency of 8,000 or 16,000 Hz. Other input/output characteristics are generally converted to 16-bit linear PCM with 8,000 or 16,000 Hz sampling before encoding, or from 16-bit linear PCM to the appropriate format after decoding.

The G.729EV coder is built upon a three-stage structure: embedded Code-Excited Linear-Prediction (CELP) coding, Time-Domain Bandwidth Extension (TDBWE) and predictive transform coding that will be referred to as Time-Domain Aliasing Cancellation (TDAC). The embedded CELP stage generates Layers 1 and 2 which yield a narrowband synthesis (50-4,000 Hz) at 8 and 12 kbit/s. The TDBWE stage generates Layer 3 and allows producing a wideband output (50-7000 Hz) at 14 kbit/s. The TDAC stage operates in the Modified Discrete Cosine Transform (MDCT) domain and generates Layers 4 to 12 to improve quality from 14 to 32 kbit/s. TDAC coding represents jointly the weighted CELP coding error signal in the 50-4000 Hz band and the input signal in the 4000-7000 Hz band.

The G.729EV coder operates on 20 ms frames. However, the embedded CELP coding stage operates on 10 ms frames, like G.729. As a result two 10 ms CELP frames are processed per 20 ms frame. The 20 ms frames used by G.729EV are referred to as superframes, whereas the 10 ms frames and the 5 ms subframes involved in the CELP processing are referred to as frames and subframes.

G729.1 Encoder

A functional diagram of the encoder part is presented in FIG. 1. The encoder operates on 20 ms input superframes. By default, the input signal 101, $s_{WB}(n)$, is sampled at 16,000 Hz., therefore, the input superframes are 320 samples long. Input signal $s_{WB}(n)$ is first split into two sub-bands using a QMF filter bank defined by the filters $H_1(z)$ and $H_2(z)$. Lower-band input signal 102, $s_{LB}^{qmf}(n)$, obtained after decimation is pre-processed by a high-pass filter $H_{h1}(z)$ with 50 Hz cut-off frequency. The resulting signal 103, $s_{LB}(n)$, is coded by the 8-12 kbit/s narrowband embedded CELP encoder. To be consistent with ITU-T Rec. G.729, the signal $s_{LB}(n)$ is also denoted as s(n). The difference 104, $d_{LB}(n)$, between s(n) and the local synthesis 105, $\hat{s}_{enh}(n)$ of the CELP encoder at 12 kbit/s is processed by the perceptual weighting filter $W_{LB}(z)$. The parameters of $W_{LB}(z)$ are derived from the quantized LP coefficients of the CELP encoder. Furthermore, filter $W_{LB}(z)$ includes a gain compensation that guarantees spectral continuity between the output 106, $d_{LB}^{w}(n)$, of $W_{LB}(z)$ and the higher-band input signal 107, $s_{HB}(n)$.

The weighted difference $d_{LB}^{w}(n)$ is then transformed into frequency domain by MDCT. The higher-band input signal 108, $s_{HB}^{fold}(n)$, obtained after decimation and spectral folding by $(-1)^n$ is pre-processed by a low-pass filter $H_{h2}(z)$ with 3000 Hz cut-off frequency. The resulting signal $s_{HB}(n)$ is coded by the TDBWE encoder. The signal $s_{HB}(n)$ is also transformed into frequency domain by MDCT. The two sets of MDCT coefficients 109, $D_{LB}^{w}(k)$, and 110, $S_{HB}(k)$, are finally coded by the TDAC encoder. In addition, some parameters are transmitted by the frame erasure concealment (FEC) encoder in order to introduce parameter-level redundancy in the bitstream. This redundancy allows improving quality in the presence of erased superframes.

TDBWE Encoder

A TDBWE encoder is illustrated in FIG. 2. The TDBWE encoder extracts a fairly coarse parametric description from the pre-processed and down-sampled higher-band signal 201, $s_{HB}(n)$. This parametric description comprises time envelope 202 and frequency envelope 203 parameters. 20 ms input speech superframe $s_{HB}(n)$ (8 kHz sampling frequency) is subdivided into 16 segments of length 1.25 ms each, i.e., each segment comprises 10 samples. The 16 time envelope parameters 102, $T_{env}(i)$, i=0, . . . , 15, are computed as logarithmic subframe energies before the quantization. For the computation of the 12 frequency envelope parameters 203, $F_{env}(j)$, j=0, . . . , 11, the signal 201, $s_{HB}(n)$, is windowed by a slightly asymmetric analysis window. This window is 128 tap long (16 ms) and is constructed from the rising slope of a 144-tap Hanning window, followed by the falling slope of a 112-tap Hanning window. The maximum of the window is centered on the second 10 ms frame of the current superframe. The window is constructed such that the frequency envelope computation has a lookahead of 16 samples (2 ms) a lookback of 32 samples (4 ms). The windowed signal is transformed by FFT. The even bins of the full length 128-tap FFT are computed using a polyphase structure. Finally, the frequency envelope parameter set is calculated as logarithmic weighted sub-band energies for 12 evenly spaced and equally wide overlapping sub-bands in the FFT domain.

G729.1 Decoder

A functional diagram of the G729.1 decoder is presented in FIG. 3. The specific case of frame erasure concealment is not considered in this figure. The decoding depends on the actual number of received layers or equivalently on the received bit rate.

If the received bit rate is:

- 8 kbit/s (Layer 1): The core layer is decoded by the embedded CELP decoder to obtain 301, $\hat{s}_{LB}(n)=\hat{s}(n)$. Then, $\hat{s}_{LB}(n)$ is postfiltered into 302, $\hat{s}_{LB}^{post}(n)$, and post-processed by a high-pass filter (HPF) into 303, $\hat{s}_{LB}^{qmf}(n)=\hat{s}_{LB}^{hpf}(n)$. The QMF synthesis filterbank defined by the filters $G_1(z)$ and $G_2(z)$ generates the output with a high-frequency synthesis 304, $\hat{s}_{HB}^{qmf}(n)$, set to zero.
- 12 kbit/s (Layers 1 and 2): The core layer and narrowband enhancement layer are decoded by the embedded CELP decoder to obtain 301, $\hat{s}_{LB}(n)=\hat{s}_{enh}(n)$, and $\hat{s}_{LB}(n)$ is then postfiltered into 302, $\hat{s}_{LB}^{post}(n)$ and high-pass filtered to obtain 303, $\hat{s}_{LB}^{qmf}(n)=\hat{s}_{LB}^{hpf}(n)$. The QMF synthesis filterbank generates the output with a high-frequency synthesis 304, $\hat{s}_{HB}^{qmf}(n)$ set to zero.
- 14 kbit/s (Layers 1 to 3): In addition to the narrowband CELP decoding and lower-band adaptive postfiltering, the TDBWE decoder produces a high-frequency synthesis 305, $\hat{s}_{HB}^{bwe}(n)$ which is then transformed into frequency domain by MDCT so as to zero the frequency band above 3000 Hz in the higher-band spectrum 306, $\hat{S}_{HB}^{bwe}(k)$. The resulting spectrum 307, $\hat{S}_{HB}(k)$ is transformed in time domain by inverse MDCT and overlap-add before spectral folding by $(-1)^n$. In the QMF synthesis filterbank the reconstructed higher band signal 304, $\hat{s}_{HB}^{qmf}(n)$ is combined with the respective lower band signal 302, $\hat{s}_{LB}^{qmf}(n)=\hat{s}_{LB}^{post}(n)$ reconstructed at 12 kbit/s without high-pass filtering.
- Above 14 kbit/s (Layers 1 to 4+): In addition to the narrowband CELP and TDBWE decoding, the TDAC decoder reconstructs MDCT coefficients 308, $\hat{D}_{LB}^{w}(k)$ and 307, $\hat{S}_{HB}(k)$, which correspond to the reconstructed weighted difference in lower band (0-4000 Hz) and the reconstructed signal in higher band (4000-7000 Hz). Note that in the higher band, the non-received sub-bands and the sub-bands with zero bit allocation in TDAC decoding are replaced by the level-adjusted sub-bands of $\hat{S}_{HB}^{bwe}(k)$. Both $\hat{D}_{LB}^{w}(k)$ and $\hat{S}_{HB}(k)$ are transformed into time domain by inverse MDCT and overlap-add. The lower-band signal 309, $\hat{d}_{LB}^{w}(n)$ is then processed by the inverse perceptual weighting filter $W_{LB}(z)^{-1}$. To attenuate transform coding artefacts, pre/post-echoes are detected and reduced in both the lower- and higher-band signals 310, $\hat{d}_{LB}(n)$ and 311, $\hat{s}_{HB}(n)$. The lower-band synthesis $\hat{s}_{LB}(n)$ is postfiltered, while the higher-band synthesis 312, $\hat{s}_{HB}^{fold}(n)$, is spectrally folded by $(-1)^n$. The signals $\hat{s}_{LB}^{qmf}(n)=\hat{s}_{LB}^{post}(n)$ and $\hat{s}_{HB}^{qmf}(n)$ are then combined and upsampled in the QMF synthesis filterbank TDBWE Decoder FIG. 4 illustrates the concept of the TDBWE decoder module. The TDBWE received parameters, which are computed by parameter extraction procedure, are used to shape an artificially generated excitation signal 402, $\hat{s}_{HB}^{exc}(n)$, according to desired time and frequency envelopes 408, $\hat{T}_{env}(i)$, and 409, $\hat{F}_{env}(j)$. This is followed by a time-domain post-processing procedure.

The TDBWE excitation signal 401, exc(n), is generated by 5 ms subframe based on parameters which are transmitted in Layers 1 and 2 of the bitstream. Specifically, the following parameters are used: the integer pitch lag $T_0=\text{int}(T_1)$ or int $(T_2)$ depending on the subframe, the fractional pitch lag frac, the energy $E_c$ of the fixed codebook contributions, and the energy $E_p$ of the adaptive codebook contribution. $E_c$ is mathematically expressed as $$E_c = \sum_{n=0}^{39} (\hat{g}_c \cdot c(n) + \hat{g}_{enh} \cdot c'(n))^2;$$

$$E_p \text{ is } E_p = \sum_{n=0}^{39} (\hat{g}_p \cdot v(n))^2.$$

The parameters of the excitation generation are computed every 5 ms subframe. The excitation signal generation consists of the following steps:

- estimation of two gains $g_v$ and $g_{uv}$ for the voiced and unvoiced contributions to the final excitation signal exc (n);
- pitch lag post-processing;
- generation of the voiced contribution;
- generation of the unvoiced contribution; and
- low-pass filtering.

In G.729.1, TDBWE is used to code the wideband signal from 4 kHz to 7 kHz. The narrow band (NB) signal from 0 to 4 kHz is coded with G729 CELP coder where the excitation consists of adaptive codebook contribution and fixed codebook contribution. The adaptive codebook contribution comes from the voiced speech periodicity; the fixed codebook contributes to unpredictable portion. The ratio of the energies of the adaptive and fixed codebook excitations (including enhancement codebook) is computed for each subframe:

$$\xi = \frac{E_p}{E_c} \tag{1}$$

In order to reduce this ratio $\xi$ in case of unvoiced sounds, a "Wiener filter" characteristic is applied:

$$\xi_{post} = \xi \cdot \frac{\xi}{1+\xi} \tag{2}$$

This leads to more consistent unvoiced sounds. The gains for the voiced and unvoiced contributions of exc(n) are determined using the following procedure. An intermediate voiced gain $g'_v$ is calculated by:

$$g'_v = \sqrt{\frac{\xi_{post}}{1+\xi_{post}}} \tag{3}$$

which is slightly smoothed to obtain the final voiced gain $g_v$:

$$g_v = \sqrt{\frac{1}{2}(g_v'^2 + g_{v,old}'^2)} \tag{4}$$

where $g'_{v,old}$ is the value of $g'_v$ of the preceding subframe.

To satisfy the constraint $g_v^2+g_{uv}^2=1$, the unvoiced gain is given by:

$$g_{uv}=\sqrt{1-g_v^2} \tag{5}$$

The generation of a consistent pitch structure within the excitation signal exc(n) requires a good estimate of the fundamental pitch lag $t_0$ of the speech production process. Within Layer 1 of the bitstream, the integer and fractional pitch lag values $T_0$ and frac are available for the four 5 ms subframes of the current superframe. For each subframe the estimation of $t_0$ is based on these parameters.

The voiced components 406, $s_{exc,v}(n)$, of the TDBWE excitation signal are represented as shaped and weighted glottal pulses. Thus $s_{exc,v}(n)$ is produced by overlap-add of single pulse contributions. The prototype pulse shapes $P_i(n)$ with i=0, . . . , 5 and n=0, . . . , 56 are taken from a lookup table, which is plotted in FIG. 5. These pulse shapes are designed such that a certain spectral shaping, i.e., a smooth increase of the attenuation of the voiced excitation components towards higher frequencies, is incorporated and the full sub-sample resolution of the pitch lag information is utilized. Further, the crest factor of the excitation signal is strongly reduced and an improved subjective quality is obtained.

The unvoiced contribution 407, $s_{exc,uv}(n)$, is produced using the scaled output of a white noise generator:

$$s_{exc,uv}(n)=g_{uv}\cdot\text{random}(n),\ n=0,\ldots,39 \tag{6}$$

Having the voiced and unvoiced contributions $s_{exc,v}(n)$ and $s_{exc,uv}(n)$, the final excitation signal 402, $s_{HB}^{exc}(n)$, is obtained by low-pass filtering of $exc(n)=s_{exc,v}(n)+s_{exc,uv}(n)$.

The low-pass filter has a cut-off frequency of 3,000 Hz and its implementation is identical with the pre-processing low-pass filter for the high band signal.

The shaping of the time envelope of the excitation signal $s_{HB}^{exc}(n)$ utilizes the decoded time envelope parameters $\hat{T}_{env}(i)$ with i=0, . . . , 15 to obtain a signal 403, $\hat{s}_{HB}^{T}(n)$, with a time envelope which is nearly identical to the time envelope of the encoder side HB signal $s_{HB}(n)$. This is achieved by a simple scalar multiplication of a gain function $g_T(n)$ with the excitation signal $s_{HB}^{exc}(n)$. In order to determine the gain function $g_T(n)$, the excitation signal $s_{HB}^{exc}(n)$ is segmented and analyzed in the same manner as described for the parameter extraction in the encoder. The obtained analysis results from $s_{HB}^{exc}(n)$ are, again, time envelope parameters $\tilde{T}_{env}(i)$ with i=0, . . . , 15. They describe the observed time envelope of $s_{HB}^{exc}(n)$. Then, a preliminary gain factor is calculated by comparing $\hat{T}_{env}(i)$ with $\tilde{T}_{env}(i)$. For each signal segment with index i=0, . . . , 15, these gain factors are interpolated using a "flat-top" Hanning window. This interpolation procedure finally yields the desired gain function.

The decoded frequency envelope parameters $\hat{F}_{env}(j)$ with j=0, . . . , 11 are representative for the second 10 ms frame within the 20 ms superframe. The first 10 ms frame is covered by parameter interpolation between the current parameter set and the parameter set from the preceding superframe. The superframe of 403, $\hat{s}_{HB}^{T}(n)$, is analyzed twice per superframe. This is done for the first (l=1) and for the second (l=2) 10 ms frame within the current superframe and yields two observed frequency envelope parameter sets $\tilde{F}_{env,l}(j)$ with j=0, . . . , 11 and frame index l=1, 2. A correction gain factor per sub-band is then determined for the first and for the second frame by comparing the decoded frequency envelope parameters $\hat{F}_{env}(j)$ with the observed frequency envelope parameter sets $\tilde{F}_{env,l}(j)$. These gains control the channels of a filterbank equalizer. The filterbank equalizer is designed such that its individual channels match the sub-band division and is defined by its filter impulse responses and a complementary high-pass contribution.

The signal 404, $\hat{s}_{HB}^{F}(n)$, is obtained by shaping both the desired time and frequency envelopes on the excitation signal $s_{HB}^{exc}(n)$ (generated from parameters estimated in lower-band by the CELP decoder). There is in general no coupling between this excitation and the related envelope shapes $\hat{T}_{env}(i)$ and $\hat{F}_{env}(j)$. As a result, some clicks may be present in the signal $\hat{s}_{HB}^{F}(n)$. To attenuate these artifacts, an adaptive amplitude compression is applied to $\hat{s}_{HB}^{F}(n)$. Each sample of $\hat{s}_{HB}^{F}(n)$ of the i-th 1.25 ms segment is compared to the decoded time envelope $\hat{T}_{env}(i)$, and the amplitude of $\hat{s}_{HB}^{F}(n)$ is compressed in order to attenuate large deviations from this envelope. The signal after this post-processing is named as 405, $\hat{s}_{HB}^{bwe}(n)$.

The SBR Principle

When analyzing the capabilities of today's leading waveform audio codecs it becomes clear that for high compression ratios of for example 20:1 and above, the resulting audio quality is not satisfactory. In this compression range, the psychoacoustic demands to stay below the so-called masking threshold curve in the frequency domain, can not be fulfilled due to bit-starvation. As a result the quantization noise introduced during the en coding process will become audible and annoying to the listener. One way to cope with this problem is to limit the audio bandwidth, such that fewer spectral lines have to be encoded. This basic trade-off is used for most waveform audio codecs. As an example, the typical bandwidth of the latest MPEG waveform codec, AAC at a bit rate of 24 kbps, mono is limited to around 7 kHz, resulting in a reasonable clean, but dull impression.

The basic idea behind SBR is the observation that usually a strong correlation between the characteristics of the high frequency range of a signal (further referred to as 'highband') and the characteristics of the low frequency range (further referred to as 'lowband') of the same signal is present. Thus, a good approximation for the representation of the original input signal highband can be achieved by a transposition from the lowband to the highband (see FIG. 6 (*a*)). In addition to the transposition, the reconstruction of the highband incorporates shaping of the spectral envelope as outlined in FIG. 6 (*b*). This process is controlled by transmission of the highband spectral envelope of the original input signal. Further guidance information sent from the encoder controls other synthesis means, such as inverse filtering, noise and sine addition, in order to cope with program material where transposition alone is insufficient. The guidance information is further referred to as SBR data. SBR data is generally coded as efficiently as possible to achieve a low overhead data rate.

The SBR process can be combined with any conventional waveform audio codec by pre-processing at the encoder side, and post-processing at the decoder side. The SBR encodes the high frequency portion of an audio signal at very low cost, whereas the conventional audio codec is still used to code the lower frequency portion of the signal. Relaxing the conventional codec by limiting its audio bandwidth while maintaining the full output audio bandwidth can, therefore, be realized. At the encoder side, the original input signal is analyzed, the highband's spectral envelope and its characteristics in relation to the lowband are encoded and the resulting SBR data is multiplexed with the core codec bitstream. At the decoder side, the SBR data is first de-multiplexed. The decoding process is organized in two stages: Firstly, the core decoder generates the low band. Secondly, the SBR decoder operates as a postprocessor, using the decoded SBR data to guide the spectral band replication process. A full bandwidth output signal is obtained. Non-SBR enhanced decoders can still decode the backward compatible part of the bit stream, resulting in only a band-limited output signal.

Whereas the basic approach seems to be simple, making it work reasonably well is not. It is a non-trivial task to code the SBR data in a way that that achieves good spectral resolution, allows sufficient time resolution on transients to avoid pre-echoes, and has a low overhead data rate that achieves a significant coding gain, and takes care of cases with low correlation between lowband and highband characteristics to avoid an artificial sound caused by using transposition and envelope adjustment alone.

SBR Combined with Traditional Audio Codecs

As mentioned above, SBR can be combined with any waveform codec. When combining AAC with SBR, the resulting codec is named aacPlus and has recently been standardized within MPEG-4 (1). Another example is mp3PRO, where SBR has been added to MPEG-1/2 Layer-3 (mp3) (3).

SBR Combined with Speech Codecs

Parametric codecs such as HVXC (Harmonic Vector eXitation Coding) or CELP generally reach a point where addition of more bits within the existing coding scheme does not lead to any significant increase in subjective audio quality. However, the SBR method has turned out to be useful also together with speech codecs. Today's listeners are used to the full audio bandwidths of CDs. Although the sound quality obtained from SBR-enhanced speech codecs is far from transparent, an increase in bandwidth from the 4 kHz or less typically offered by speech codecs to 10 kHz or more is generally appreciated. Furthermore, the speech intelligibility under noisy listening conditions increases, since reproduction of fricatives ('s', 'f' etc) improves once the bandwidth is extended.

SUMMARY OF THE INVENTION

In one embodiment, a method of transceiving an audio signal is disclosed. The method includes providing low band spectral information having a plurality of spectrum coefficients and predicting a high band extended spectral fine structure from the low band spectral information for at least one subband, where the high band extended spectral fine structure are made of a plurality of spectrum coefficients. The predicting includes preparing the spectrum coefficients of the low band spectral information, defining prediction parameters for the high band extended spectral fine structure and index ranges of the prediction parameters, and determining possible best indices of the prediction parameters, where determining includes minimizing a prediction error between a reference subband in high band and a predicted subband that is selected and composed from an available low band. The possible best indices of the prediction parameters are transmitted.

In another embodiment, a method of receiving an encoded audio signal is disclosed. The method includes receiving the encoded audio signal, where the encoded audio signal has an available low band comprising a plurality of spectrum coefficiants, and predicting an extended spectral fine structure of a high band from the available low band. The spectral fine structure of the high band has at least one subband having a plurality of spectrum coefficiants. Predicting includes preparing the plurality of spectrum coefficiants of the available low band, defining prediction parameters and variation ranges of the prediction parameters based on the available low band, and estimating possible best prediction parameters based on a regularity of a harmonic structure of the available low band. The extended spectral fine structure of the high band based on the estimated possible best prediction parameters of the at least one subband is produced.

In a further embodiment, a system for transmitting an audio signal is disclosed. The system has a transmitter that includes an audio coder, which is configured to convert the audio signal to low band spectral information having a plurality of spectrum coefficients, and predict a high band extended spectral fine structure from the low band spectral information for at least one subband, where the high band extended spectral fine structure has a plurality of spectrum coefficients. The audio coder is further configured to prepare the spectrum coefficients of the low band spectral information, define prediction parameters for the high band extended spectral fine structure and index ranges of the prediction parameters, determine possible best indices of the prediction parameters, and produce an encoded audio signal have the possible best indices of the prediction parameters. A prediction error is minimized between a reference subband in high band and a predicted subband that is selected and composed from an available low band. The transmitter is further configured to transmit the encoded audio signal.

In another embodiment, a method can be used for intra frame frequency prediction with limited bit budget to predict extended spectral fine structure in a high band from an available low band. The available low band has a number of spectrum coefficients. The extended spectral fine structure in high band has at least one subband and possibly a plurality of subbands. Each subband has a plurality of spectrum coefficients. Each subband prediction includes preparing the spectrum coefficients of the available low band which is available in both encoder and decoder. The prediction parameters and the index ranges of the prediction parameters are defined. Possibly best indices of the prediction parameters are determined by minimizing the prediction error in encoder between the reference subband in high band and the predicted subband which is selected and composed from the available low band. The indices of the prediction parameters are transmitted from encoder to decoder. The extended spectral fine structure in high band is produced at decoder by making use of the transmitted indices of the prediction parameters of the each subband.

In one example, the prediction parameters are the prediction lag and sign.

In another example, the available low band can be modified before doing the intra frame frequency prediction as long as the same modification is performed in both encoder and decoder.

In another example, the minimization of the prediction error for each subband is equivalent to the minimization of the following error definition:

$$\mathrm{Err_F}(k'_p, \mathrm{sign}) = \sum_k \left[\mathrm{sign}\cdot \hat{S}_{LB}(k + k'_p) - S_{ref}(k)\right]^2$$

by selecting best $k'_p$ and sign, wherein $k'_p$ and sign are the prediction parameters, $k'_p$ is also called the prediction lag, sign equals 1 or −1, $S_{ref}(\cdot)$ is the reference coefficients of the reference subband, $S_{ref}(\cdot)$ is also called the ideal spectrum coefficients, and $\hat{S}_{LB}(\cdot)$ represents the available low band.

In another example, the minimization of the prediction error for each subband is also equivalent to the maximization of the following expression:

$$\text{Max}\left\{\frac{\left[\sum_k \hat{S}_{LB}(k+k'_p)\cdot S_{ref}(k)\right]^2}{\sum_k \left[\hat{S}_{LB}(k+k'_p)\right]^2}, \text{ for possible } k'_p\right\}$$

by selecting best $k'_p$ and sign, wherein sign is determined by $$\text{If} \quad \sum_k \hat{S}_{LB}(k+k'_p)\cdot S_{ref}(k) \quad >= 0, \quad \text{sign} = 1;$$
$$\text{else} \qquad \text{sign} = -1$$

In another example, the extended spectral fine structure of the each subband in high band at decoder is produced by using the transmitted prediction parameters:

$$\hat{S}_p(k)=\hat{S}_{HB}(k)=S_{BWE}(k)=S_h(k)=\text{sign}\cdot\hat{S}_{LB}(k+k'_p)$$

wherein $k'_p$ and sign are the prediction parameters, $k'_p$ is also called the prediction lag, sign equals 1 or −1, $\hat{S}_{LB}(\cdot)$ represents the available low band, and $\hat{S}_p(\cdot)=\hat{S}_{HB}(\cdot)=\hat{S}_{BWE}(\cdot)=S_h(\cdot)$ means the predicted portion of the extended subband. The energy level of which is not important at this stage as the final energy of the each predicted subband in high band will be scaled to correct level by using transmitted the spectral envelope information.

In another example, the intra frame frequency prediction can be performed in Log domain, Linear domain, or weighted domain.

In another embodiment, a method provides intra frame frequency prediction with no bit budget to predict the extended spectral fine structure in high band from the available low band. The available low band has a plurality of spectrum coefficients. The extended spectral fine structure in high band has at least one subband and possibly a plurality of subbands. Each subband has a plurality of spectrum coefficients. Each subband prediction includes preparing the spectrum coefficients of the available low band which is available in decoder. The prediction parameters and the variation ranges of the prediction parameters are defined and the possibly best prediction parameters are defined by benefitting from the regularity of harmonic structure of the available low band. The extended spectral fine structure in high band are produced at the decoder by making use of the estimated prediction parameters of the each subband.

In one example, the prediction parameter is the copying distance estimated by finding the locations of harmonic peaks and measuring the distance of two harmonic peaks.

In another example, the prediction parameter is the copying distance, also called prediction lag, which is estimated by maximizing the correlation between two harmonic segments in the available low band.

The foregoing has outlined, rather broadly, features of the present invention. Additional features of the invention will be described, hereinafter, which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

Figure 1:
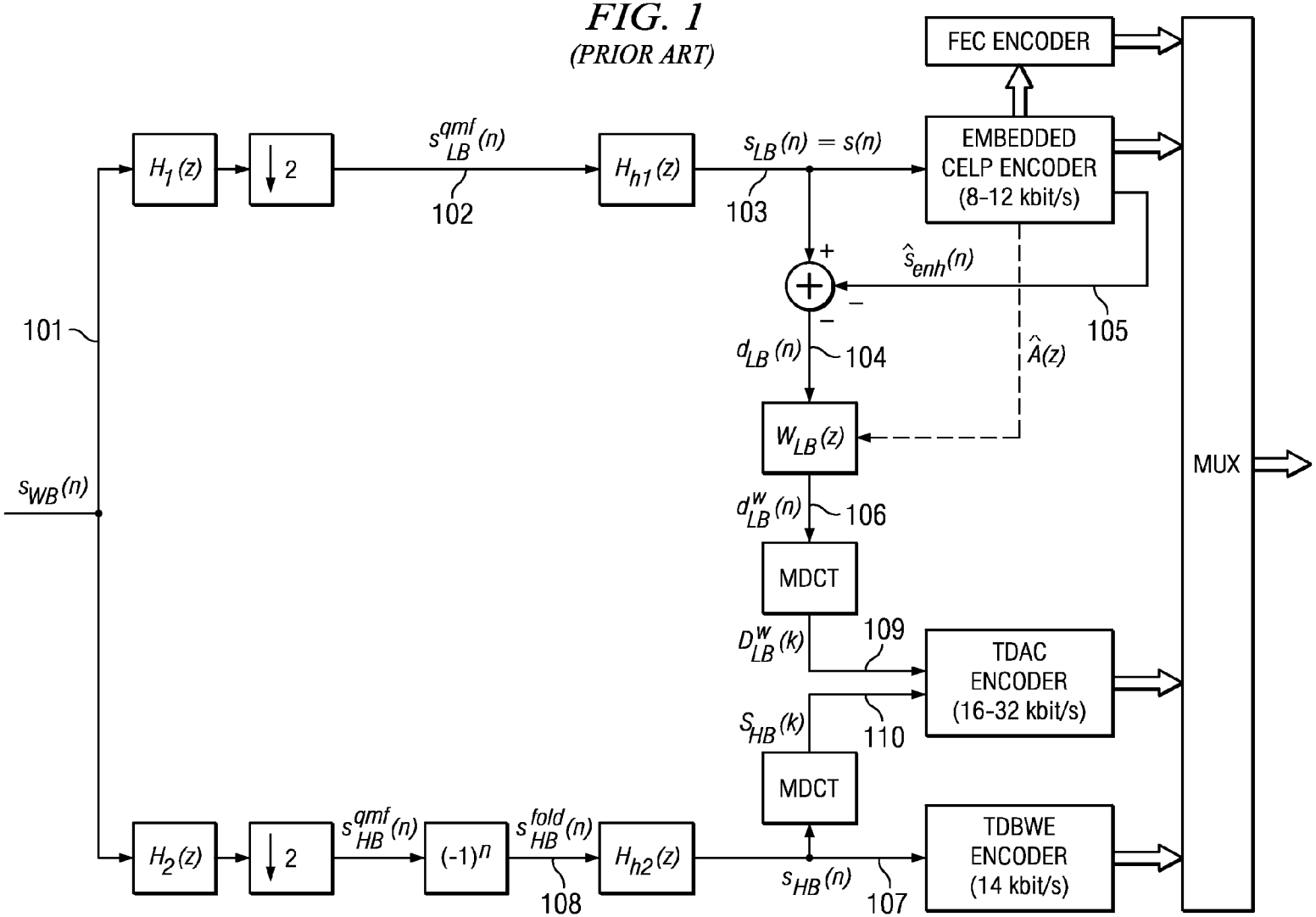
FIG. 1 (PRIOR ART)
FIG. 1 illustrates a high-level block diagram of a prior art ITU-T G.729.1 encoder.
Figure 2:
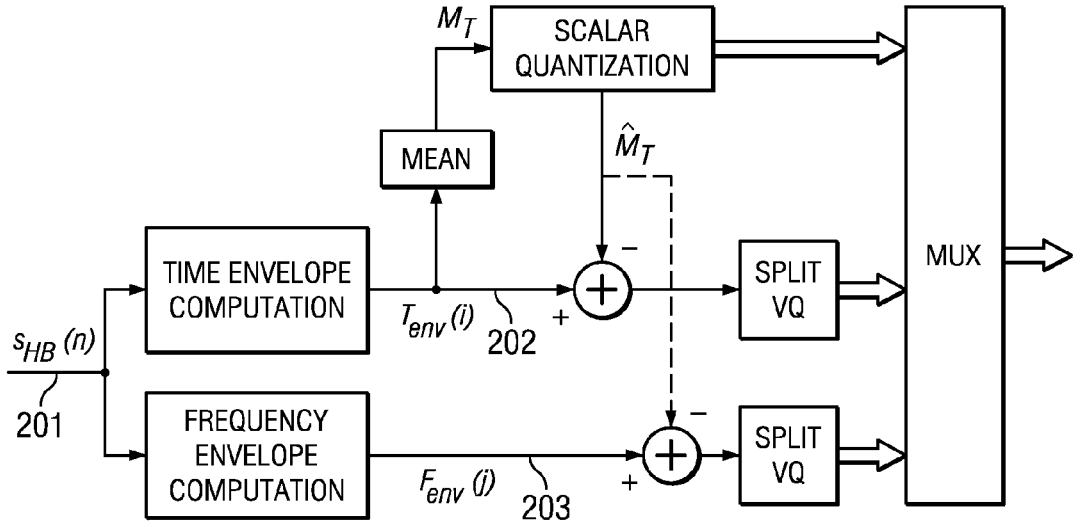
FIG. 2 (PRIOR ART)
FIG. 2 illustrates a high-level block diagram of a prior art TDBWE encoder for the ITU-T G.729.1.

Corresponding numerals and symbols in different figures generally refer to corresponding parts unless otherwise indicated. The figures are drawn to clearly illustrate the relevant aspects of embodiments of the present invention and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of embodiments are discussed in detail below. It should be appreciated, however, that the present invention provides many applicable inventive concepts that may be embodied in a wide variety of specific contexts. The specific embodiments discussed are merely illustrative of specific ways to make and use the invention, and do not limit the scope of the invention.

The present invention will be described with respect to embodiments in a specific context, namely a system and method for performing low bit rate speech and audio coding for telecommunication systems. Embodiments of this invention may also be applied to systems and methods that utilize speech and audio transform coding.

Embodiments of the present invention include systems and methods of intra frame frequency prediction both with and without having bit budget. The intra frame frequency prediction with a bit budget can work well for spectrum structures that are not enough harmonic. Intra frame frequency prediction without a bit budget can work well for spectrums having a regular harmonic structure. Although the disclosed embodiments define the specific range of the extended subbands, in alternative embodiments, the general principle is kept the same when the defined frequency range is changed. In general, embodiments of the present invention uses intra frame adaptive frequency prediction technology that uses a bit rate between VQ and BWE technology, however, the resulting bit rate may vary in alternative embodiments.

Similar or same concepts as BWE are High Band Extension (HBE), SubBand Replica, Spectral Band Replication (SBR) or High Frequency Reconstruction (HFR). Although the name could be different, they all have a similar meaning of encoding/decoding some frequency sub-bands (usually high bands) with little budget of bit rate or significantly lower bit rate than normal encoding/decoding approach. BWE often encodes and decodes some perceptually critical information within bit budget while generating some information with very limited bit budget or without spending any number of bits; BWE usually comprises frequency envelope coding, temporal envelope coding (optional in time domain), and spectral fine structure generation. Precise description of spectral fine structure needs a lot of bits, which may become unrealistic for BWE algorithms. Embodiments of the present invention, however, artificially generate spectral fine structure or only spend little bit budget to code spectral fine structure. The corresponding signal in time domain of spectral fine structure can be in excitation time domain or perceptually weighted time domain.

For a BWE algorithm, the generation of spectral fine structure have the following possibilities: some available subbands are copied to extended subbands, or extended subbands are constructed by using some available parameters in time domain or frequency domain. Embodiments of the present invention utilize solutions in which adaptive frequency prediction approach is used to construct spectral fine structure at very low bit rate or generate harmonic spectral fine structure without spending bit budget. The predicted spectrum can be further possibly mixed with random noise to finally compose spectral fine structure or excitation. In particular, embodiments of the present invention can be advantageously used when ITU G.729.1/G.718 codecs are in the core layers for a scalable super-wideband codec. Frequency domain can be defined as FFT transformed domain; it can also be in MDCT (Modified Discrete Cosine Transform) domain. The following exemplary embodiments will operate in MDCT domain.

In an embodiment, spectral fine structure construction or generation (excitation construction or generation) is used, where the high band is also produced in terms of available low band information but in a way called intra frame frequency prediction. The intra frame frequency prediction spends a limited bit budget to search for best prediction lag at encoder or cost no bit to search for best prediction lag at decoder only.

The TDBWE in G729.1 aims to construct the fine spectral structure of the extended subbands of [4 k, 7 kHz] by using parameters from CELP in [0, 4 kHz]. The given example of SBR copies the first half spectrum (low band) to the second half spectrum (high band) and then modifies it. Some embodiments of the present invention approach the problem in a more general manner and are not limited to specific extended subbands. However, in some exemplary embodiments, extended subbands are defined from 7 kHz to 14 kHz, assuming that low bands from 0 to 7 k Hz are already encoded and transmitted to the decoder. In these exemplary embodiments, the sampling rate of the original input signal is 32 kHz. The signal at the sampling rate of 32 kHz covering a [0, 16 kHz] bandwidth is called a super-wideband (SWB) signal, the down-sampled signal covering [0, 8 kHz] bandwidth is called a wideband (WB) signal, and the further down-sampled signal covering [0, 4 kHz] bandwidth is called a narrowband (NB) signal. These exemplary embodiments construct the extended subbands covering [7 kHz, 14 kHz] by using available spectrum of [0, 7 kHz]. Similar methods can also be employed to extend NB spectrum of [0, 4 kHz] to the WB area of [4 k, 8 kHz] if NB is available while [4 k, 8 kHz] is not available at decoder side. Of course, in alternative embodiments of the present invention, other sampling rates and bandwidths can be used depending on the application and its requirements. Since embodiments of the present invention can be used for a general signal with different frequency bandwidths, including speech and music, the notation here will be slightly different from the G.729.1. The generated fine spectral structure is noted as a combination of harmonic-like component and noise-like component:

$$S_{BWE}(k)=g_h\cdot S_h(k)+g_n\cdot S_n(k) \tag{7}$$

In the equation (7), $S_h(k)$ contains harmonics, $S_n(k)$ is random noise; $g_h$ and $g_n$ are the gains to control the ratio between the harmonic-like component and noise-like component; these two gains could be subband dependent. When $g_n$ is zero, $S_{BWE}(k)=S_h(k)$. Embodiments of the present invention predict extended subbands $S_h(k)$ by spending small number of bits or even zero bits, which contributes to the successful construction of the extended fine spectral structure, because the random noise portion is easy to be generated. It should be noted that the absolute energy of $S_h(k)$ or $S_{BWE}(k)$ in each subband is not important here because the final spectral envelope will be shaped later by the spectral envelope coding block. Each subband size should be small enough so that the spectral envelope in each subband is almost flat or smoothed enough; the spectrum in the equation (7) can be in Log domain or Linear domain.

Two kinds of frequency prediction are presented here: (1) with limited bit budget to find the best prediction parameters (prediction lag and sign) in encoder and then sent to decoder; (2) with zero bit budget to find the extended subbands at decoder by profiting regular harmonic structure.

In an embodiment, subband [7 k, 8 kHz] is predicted from [0, 7 kHz] if [7 k, 8 kHz] is not available and [0, 7 kHz] is available at decoder side. The prediction of other subbands above 8 kHz can be done in a similar way. [7 k, 8 kHz] can be just one subband or divided into two subbands or even more subbands, depending on bit budget; each subband of [7 k, 8 kHz] can be predicted from [0, 7 kHz] in a similar way. Suppose $S_{ref}(k)$ is the reference of the unquantized MDCT coefficients in one subband, two parameters can be determined by minimizing the following error, $$\text{Err_F}(k_p)=\sum_k\left[\text{sign}\cdot\hat{S}_{wb}(k+280-k_p)-S_{ref}(k)\right]^2 \tag{8}$$

In (8), $\hat{S}_{wb}(\,)$ is noted as WB quantized MDCT coefficients without counting the spectral envelope, and $\hat{S}_{wb}(\mathbf{280})$ represents the coefficient at frequency of 7 kHz; The two parameters of $k_p$ and sign are determined; $k_p$ can also be converted as $k'_p=\mathbf{280}-k_p$ (it is the same to send $k'_p$ or $k_p$ to decoder). $k'_p$ or $k_p$ is the prediction lag (prediction index). The range of $k'_p$ or $k_p$ depends on the number of bits and has to make sure that the best lag searching is not out of the available range of [0,280] MDCT coefficients. spending some embodiments, 7 bits or 8 bits are used to code $k'_p$ or $k_p$. $k'_p$ or $k_p$ can be found by testing all possible $k'_p$ or $k_p$ index and by maximizing the following equation, $$\text{Max}\left\{\frac{\left[\sum_k\hat{S}_{wb}(k+280-k_p)\cdot S_{ref}(k)\right]^2}{\sum_k\left[\hat{S}_{wb}(k+280-k_p)\right]^2},\ \text{for possible } k_p\right\} \tag{9}$$

During the searching of the best $k'_p$ or $k_p$, zero value area of $\hat{S}_{wb}(\,)$ is preferably skipped and not counted in the final index sent to decoder. Zero value area of $\hat{S}_{wb}(\ )$ can be also filled with non-zero values before doing the searching, but the filling of non-zero values must be performed in the same way for both encoder and decoder. After $k'_p$ or $k_p$ is determined, sign is determined in the following way:

$$R_f = \sum_k \hat{S}_{wb}(k + 280 - k_p) \cdot S_{ref}(k), \tag{10}$$

if $R_f >= 0$, sign = 1 else sign = −1 sign is sent to decoder with 1 bit. At decoder side, the predicted coefficients can be expressed as, $$\hat{S}_p(k) = \text{sign} \cdot \hat{S}_{wb}(k+280-k_p \tag{11}$$

$\hat{S}_p(k)$ is assigned to $S_h(k)$ if the equation (7) is used to form the final extended subbands. The basic principle of intra frame frequency prediction at encoder side as described above.

Figure 7:
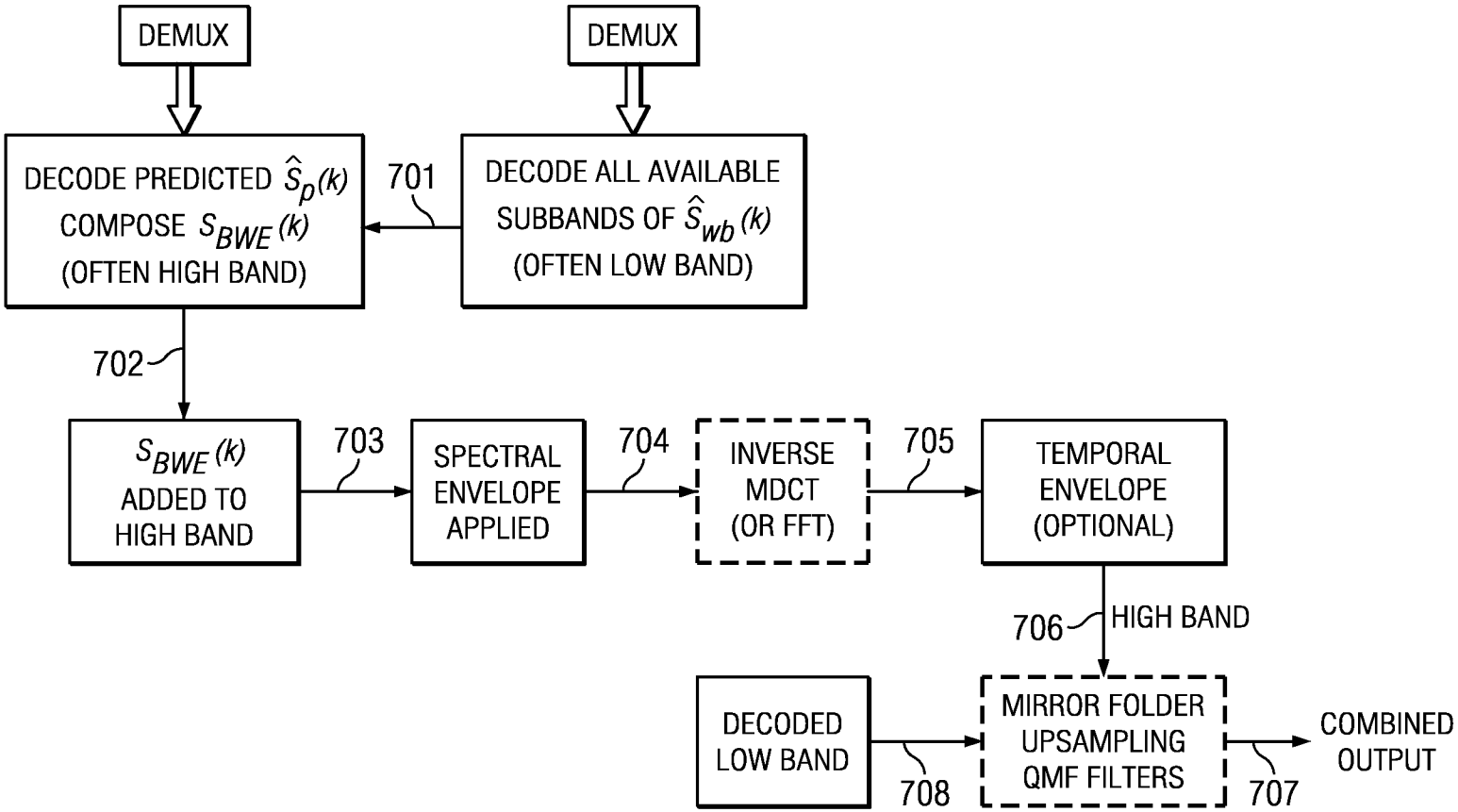
FIG. 7 illustrates an embodiment decoder that performs intra frame frequency prediction at limited bit rate.

FIG. 7 illustrates a block diagram of an embodiment system of frequency prediction at the decoder side. In FIG. 7, 701 provides all possible candidates from low band. Predicted subband 702 is formed by selecting one candidate based on the transmitted prediction lag $k'_p$ or $k_p$ and by applying the transmitted sign. After the final spectral fine structure 703 is determined, the spectral envelope is shaped by using transmitted gain or energy information. The shaped high band 704 is then combined with decoded low band 708 in time domain or in frequency domain. If it is in frequency domain, the other 3 blocks in dash-dot are not needed; if the combination is done in time domain, both high band and low band are inverse-transformed into time domain, up-sampled and filtered in QMF filters.

Figure 8:
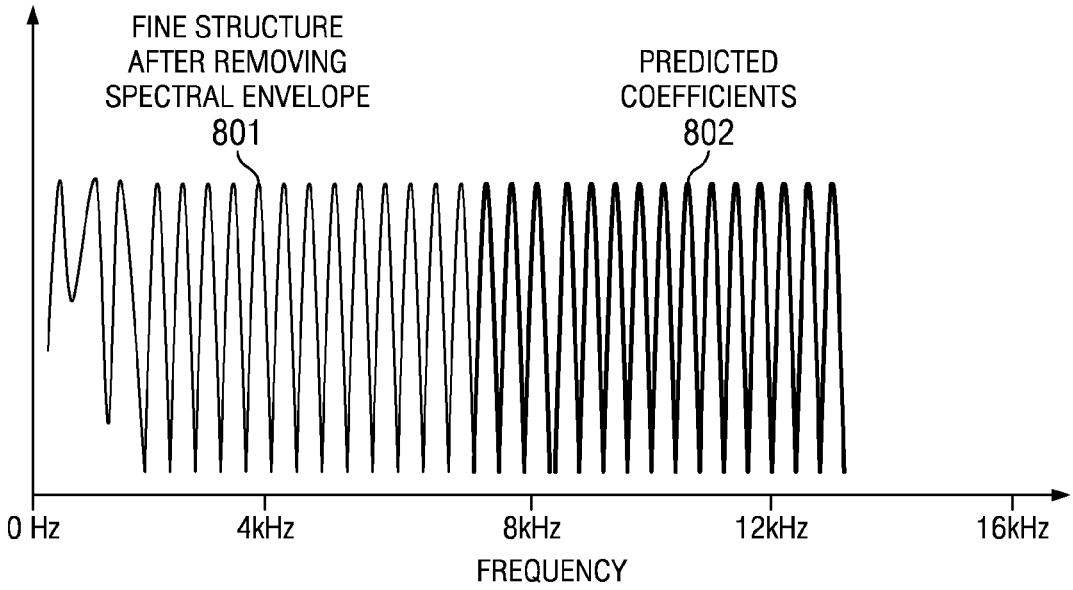
FIG. 8 illustrates an example spectrum of intra frame frequency prediction with limited bit budget.

FIG. 8 illustrates an embodiment spectrum with frequency prediction of [7 k, 8 kHz] or above and without counting the spectral envelope. The illustrated spectrum is simplified for the sake of illustration and does not show the negative spectrum coefficients and amplitude irregularities of a real spectrum. Section 801 is a decoded low band fine spectrum structure and section 802 is a predicted high band fine spectrum structure.

In an embodiment method of intra frame frequency prediction with a limited bit budget to predict extended spectral fine structure in high band from available low band, the available low band preferably has a plurality of spectrum coefficients, which can be modified as long as the same modification is performed in both encoder and decoder. In some embodiments, the energy level of the available low band is not important at this stage because the final energy or magnitude of each subband in high band predicted from the available low band will be scaled later to correct level by using transmitted spectral envelope information.

In some embodiments, the extended spectral fine structure in high band has at least one subband and possibly a plurality of subbands. Each subband should have a plurality of spectrum coefficients. Each subband prediction has the steps of: preparing spectrum coefficients of low band which is available in both encoder and decoder; defining prediction parameters and index ranges of the prediction parameters; determining possibly best indices of the prediction parameters by minimizing the prediction error in encoder between the reference subband in high band and the predicted subband which is selected and composed from the available low band; transmitting the indices of the prediction parameters from encoder to decoder; and producing the extended spectral fine structure in high band at decoder by making use of the transmitted indices of the prediction parameters of each subband. Normally, the prediction parameters are the prediction lag and sign. The intra frame frequency prediction can be performed in Log domain, Linear domain, or any weighted domain. The above described embodiment predicts the extended frequency subbands with limited bit budget, and works well for spectrums that are not adequately harmonic.

In another embodiment, frequency prediction is performed without spending any additional bits, which can be used where regular harmonics are present. Suppose $\hat{S}_{wb}(k)$ is wideband spectrum of [0, 8 kHz] which is already available at decoder side, the high band of [8 k, 14 kHz] can be predicted by analyzing the low band of [0, 8 kHz]. The zero bit frequency prediction also does not count the spectral envelope which will be applied later by using transmitted gains or energies. It is further supposed that the minimum distance between two adjacent harmonic peaks is $F0_{min}$ and the maximum distance between two adjacent harmonic peaks is $F0_{max}$.

An embodiment zero bit frequency prediction procedure has of the following steps:

- Search for the maximum peak energy in the region [(8 k−$F0_{max}$)Hz, 8 kHz] of $\hat{S}_{wb}(k)$; note the peak position as $k_{p1}$.
- Search for the maximum peak energy in the region ⌊($k_{p1}$+$F0_{min}$)Hz, 8 kHz⌋ of $\hat{S}_{wb}(k)$; note the peak position as $k_{p2}$.
- Search for the maximum peak energy in the region ⌊($k_{p1}$−$F0_{max}$)Hz, ($k_{p1}$−$F0_{min}$)Hz⌋of $\hat{S}_{wb}(k)$; note the peak position as $k_{p3}$.
- If the energy at $k_{p2}$ is bigger than the energy at $k_{p3}$, the copying distance $K_d$ used to predict the extended high band is defined as $$K_d = k_{p2} - k_{p1} \tag{12}$$

- If the energy at $k_{p3}$ is bigger than the energy at $k_{p2}$, the copying distance $K_d$ used to predict the extended high band is defined as $$K_d = k_{p1} - k_{p3} \tag{13}$$

- With the estimated copying distance $K_d$, repeatedly copy [(8 k−$K_d$)Hz, 8 kHz] to [8 kHz, (8 k+$K_d$)Hz], [(8 k+$K_d$) Hz, (8 k+2$K_d$)Hz], . . . , until [8 k, 14 kHz] is covered.
- The copied [8 k, 14 kHz] is assigned to $S_h(k)$ in the equation (7) to form $S_{BWE}(k)$.

Figure 9:
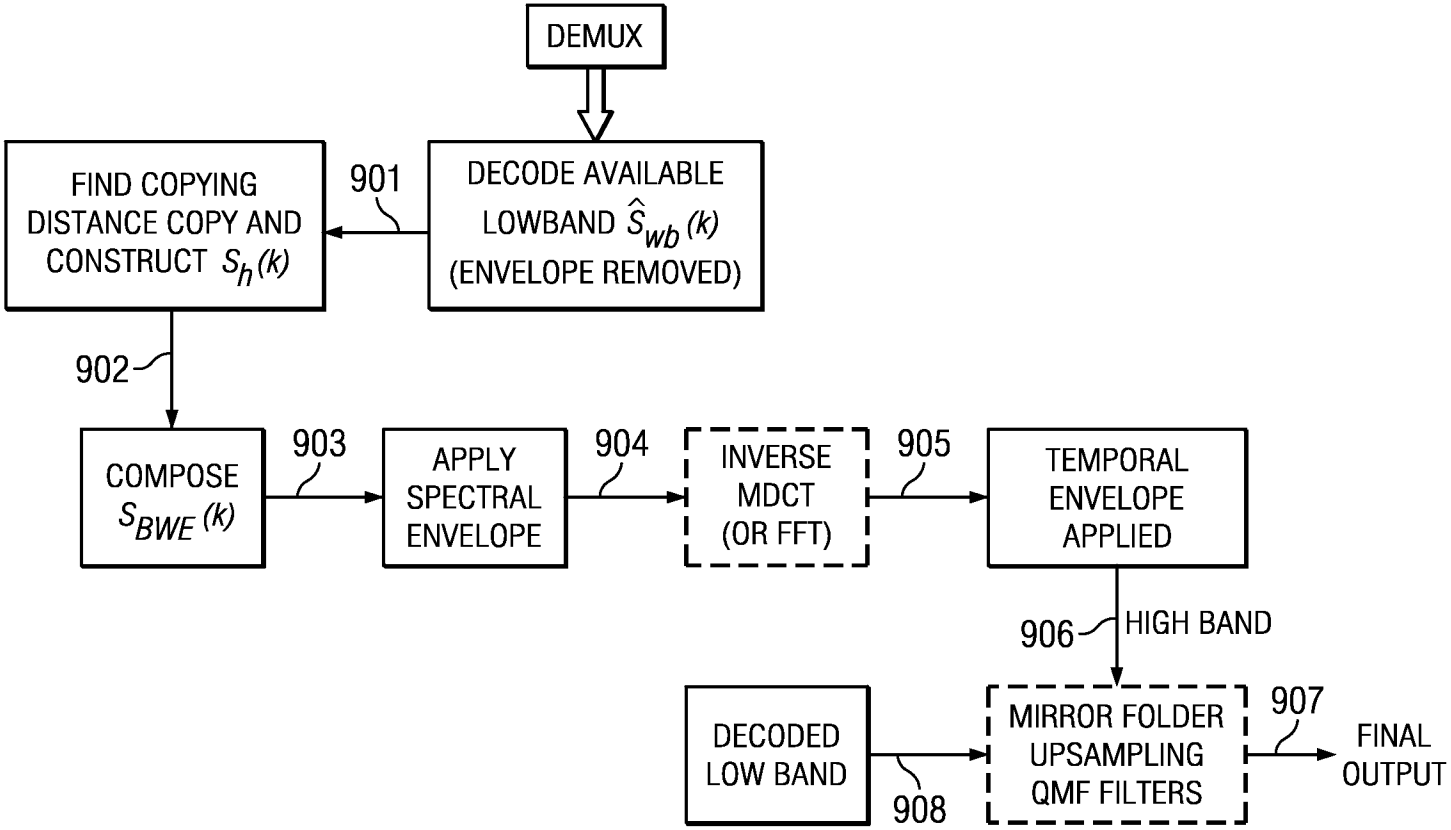
FIG. 9 illustrates an embodiment decoder that performs intra frame frequency prediction with zero bit rate at decoder side.

FIG. 9 illustrates a block diagram of the above described embodiment system. In FIG. 9, 901 provides all possible candidates from low band. Predicted subband 902 is formed by selecting one candidate based on the estimated copying distance. After the final spectral fine structure 903 is determined, the spectral envelope is shaped by using transmitted gain or energy information. Shaped high band 904 is then combined with decoded low band 908 in time domain or in frequency domain. If the combination is done in the frequency domain, the other 3 blocks in the dash-dot blocks are not needed. If the combination is performed in time domain, both high band and low band are inverse-transformed into time domain, up-sampled and filtered in QMF filters.

Figure 10:
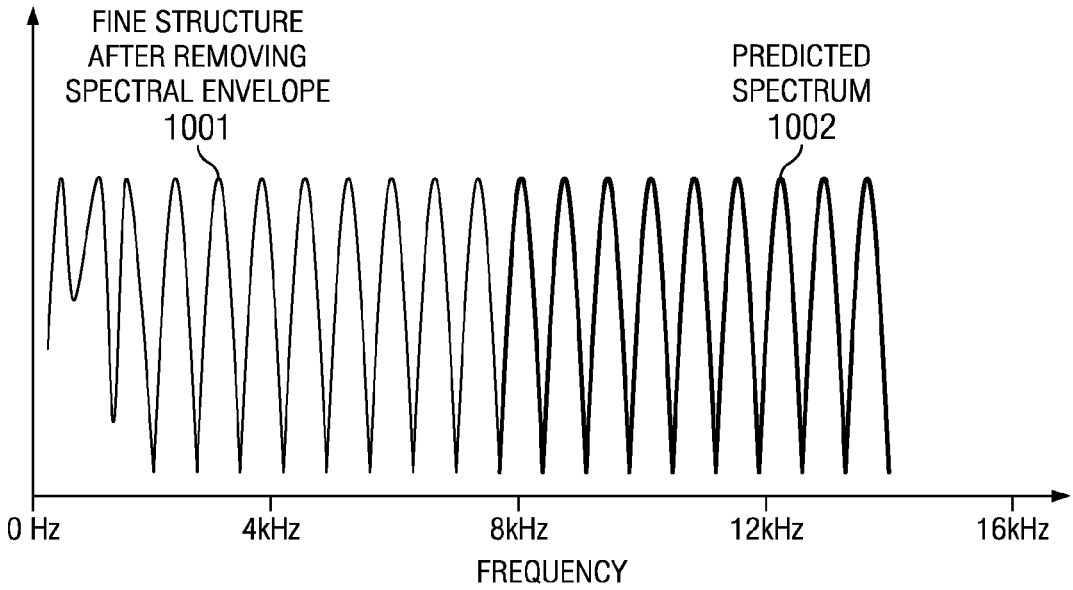
FIG. 10 illustrates an example spectrum of frequency prediction with zero bit rate.

FIG. 10 illustrates an embodiment spectrum from performing a zero bit frequency prediction without counting spectral envelope. The illustrated spectrum is simplified for the sake of illustration and does not show the negative spectrum coefficients and amplitude irregularities of a real spectrum. Section 1001 is a decoded low band fine spectrum structure and 1002 is a predicted high band fine spectrum structure based on the estimated copying distance.

In an embodiment method of intra frame frequency prediction with no bit budget to predict extended spectral fine structure in high band from available low band, the available low band preferably has a plurality of spectrum coefficients. The extended spectral fine structure in high band preferably has at least one subband and possibly a plurality of subbands and each subband preferably has a plurality of spectrum coefficients. Each subband prediction has the steps of: preparing spectrum coefficients of available low band which is available in the decoder; defining prediction parameters and variation ranges of the prediction parameters; estimating possibly best prediction parameters by benefitting from regularity of harmonic structure of the available low band; producing the extended spectral fine structure in high band at decoder by making use of the estimated prediction parameters for each subband; one prediction parameter is the copying distance estimated by finding the locations of harmonic peaks and measuring the distance of two harmonic peaks The copying distance also called prediction lag can be also estimated by maximizing the correlation between two harmonic segments in the available low band.

Figure 11:
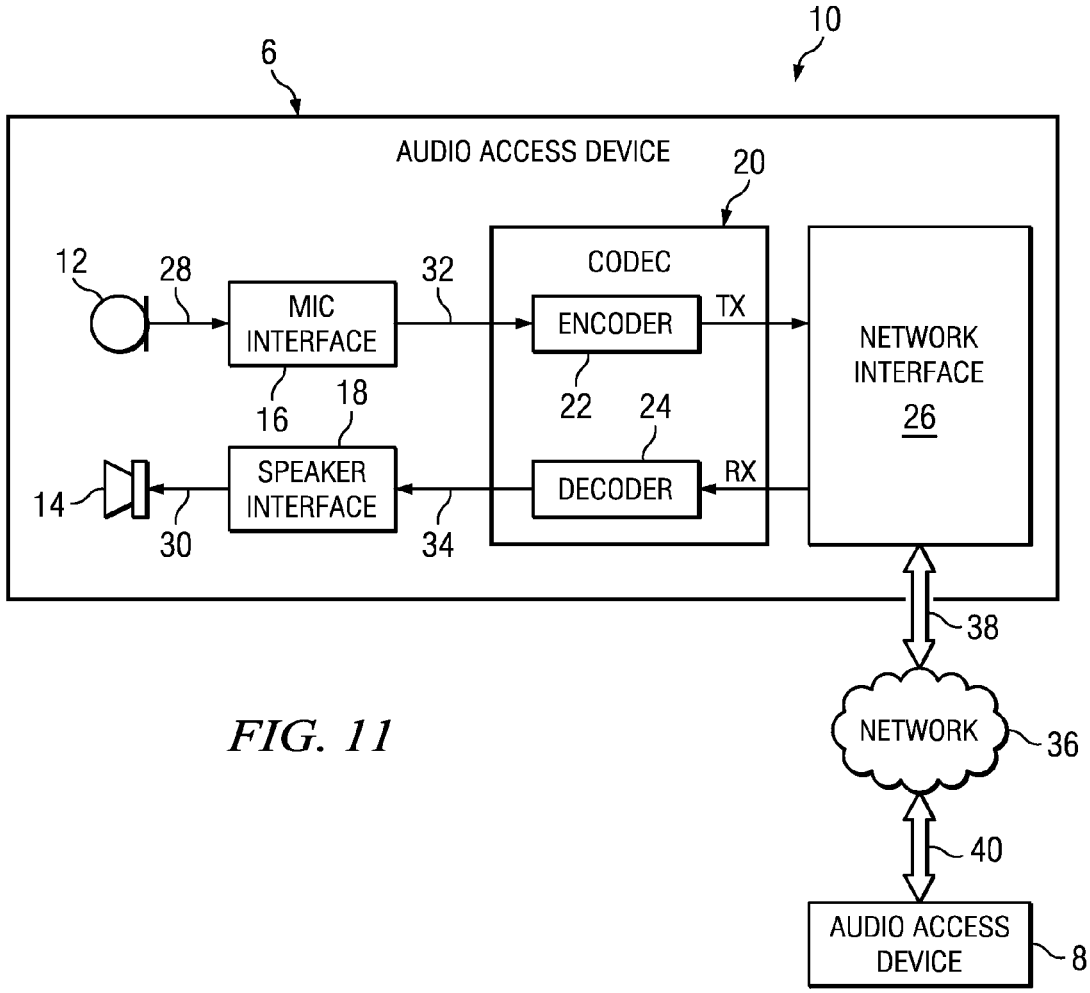
FIG. 11 illustrates a communication system according to an embodiment of the present invention.
Figure 3:
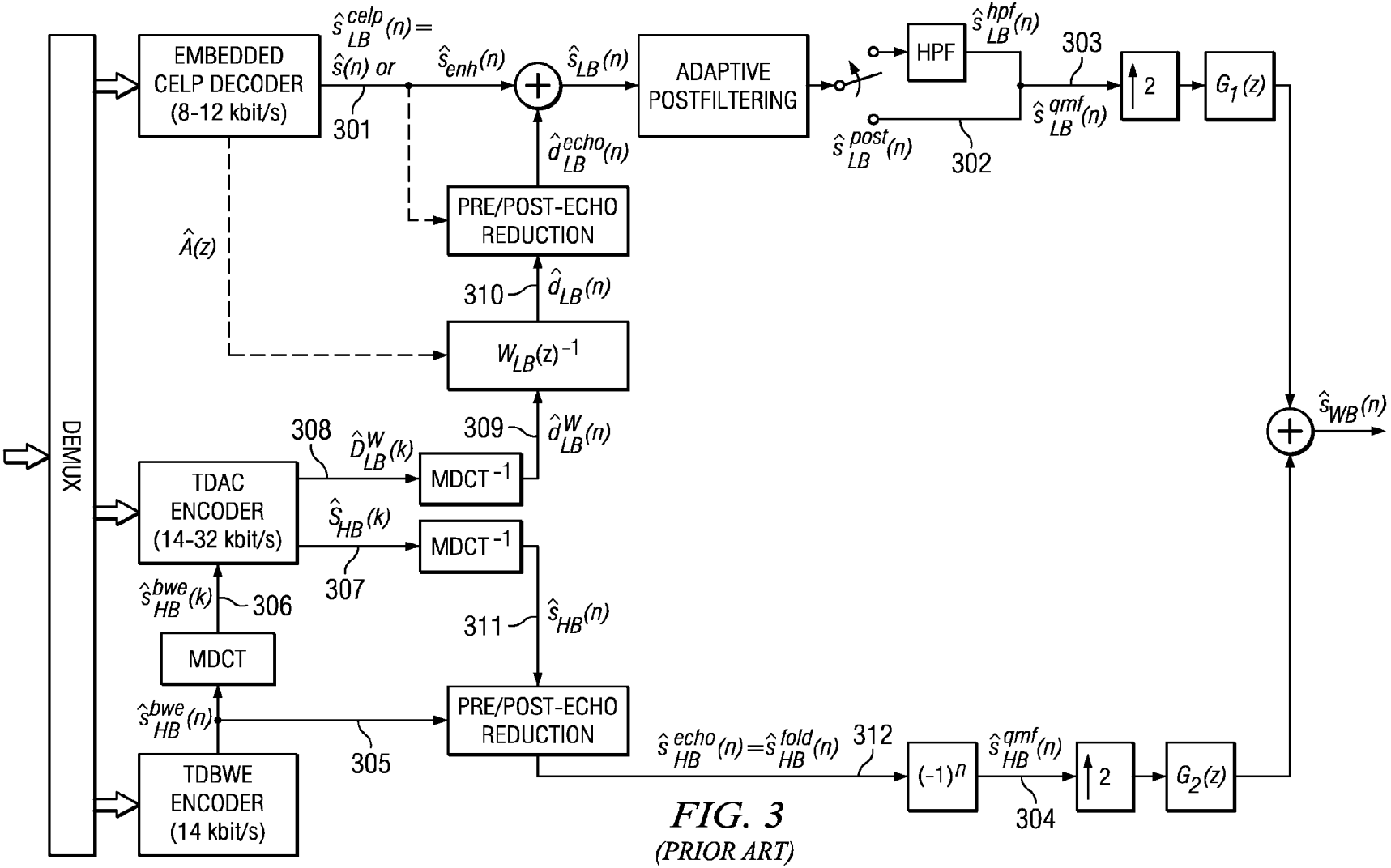
FIG. 3 (PRIOR ART)
FIG. 3 illustrates a high-level block diagram of a prior art ITU-T G.729.1 decoder.
Figure 4:
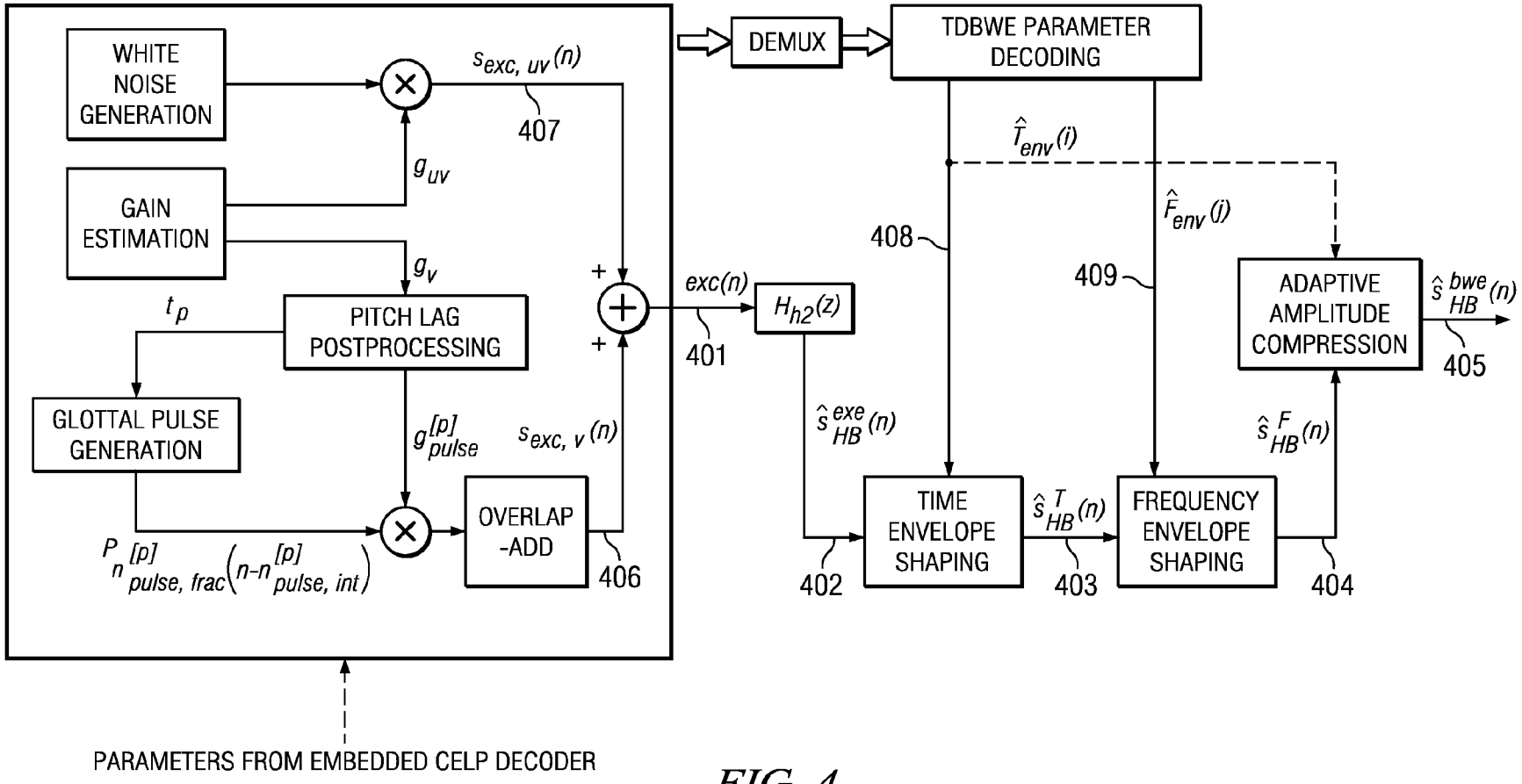
FIG. 4 (PRIOR ART)
FIG. 4 illustrates a high-level block diagram of a prior art TDBWE decoder for G.729.1.
Figure 5:
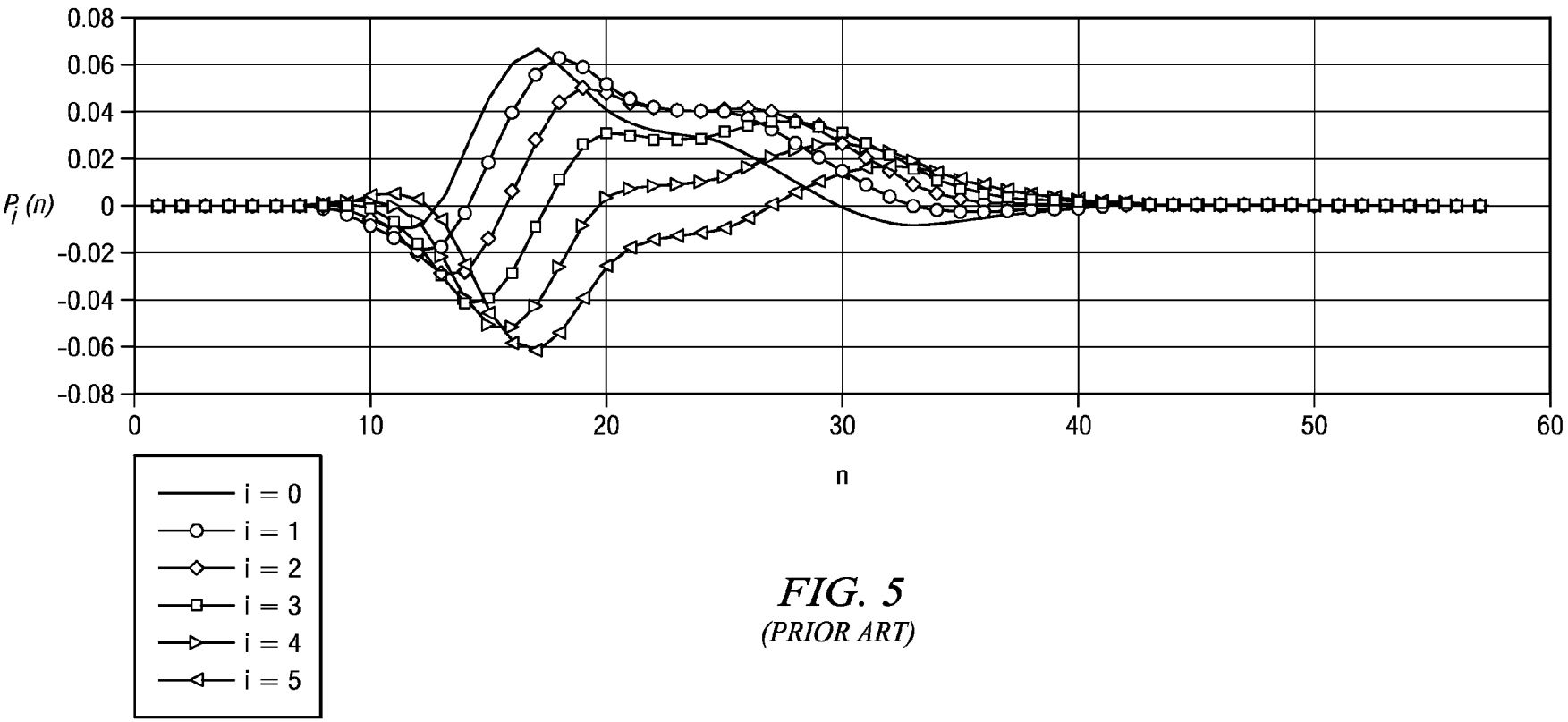
FIG. 5 (PRIOR ART)
FIG. 5 illustrates a pulse shape lookup table for TDBWE.
Figure 6A:
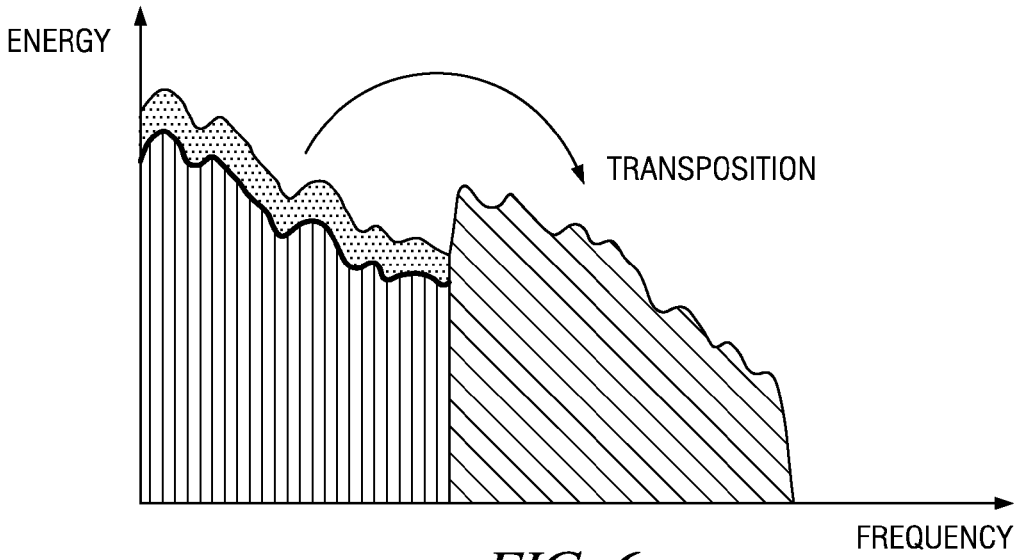
FIG. 6a (PRIOR ART)
FIG. 6 (*a*) illustrates an example of SBR creating high frequencies by transposition, and FIG. 6(*b*) gives an example of SBR adjusting envelope of the highband.
Figure 6B:
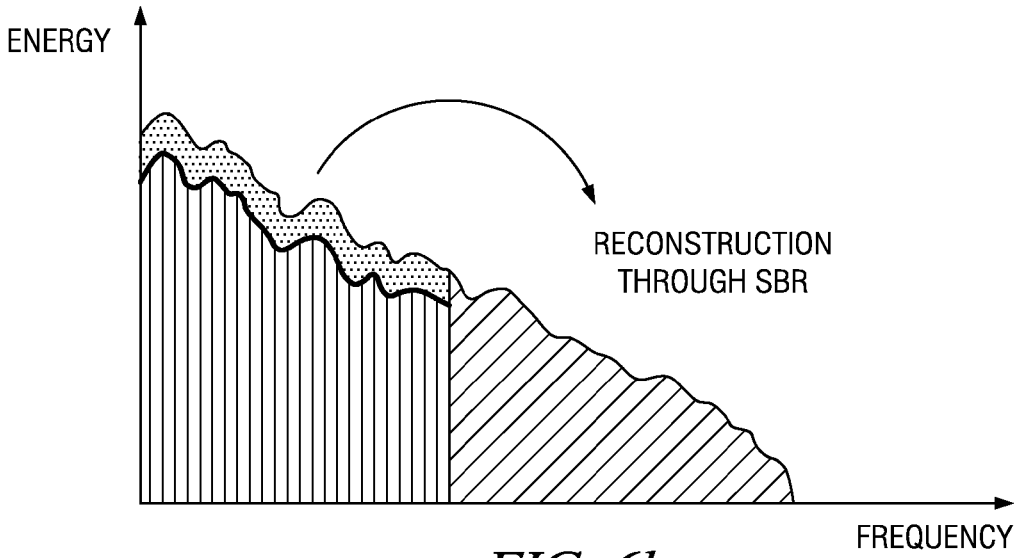
FIG. 6b (PRIOR ART)

FIG. 11 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PTSN) and/or the internet. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In embodiments of the present invention, where audio access device 6 is a VOIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

Embodiments of intra frame frequency prediction to produce the extended fine spectrum structure are described above. However, one skilled in the art will recognize that the present invention may be practiced in conjunction with various encoding/decoding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention which use the principles of the present invention are not specifically described in the present application and are not specifically illustrated by the present drawings.

It will also be readily understood by those skilled in the art that materials and methods may be varied while remaining within the scope of the present invention. It is also appreciated that the present invention provides many applicable inventive concepts other than the specific contexts used to illustrate embodiments. For example, in alternative embodiments of the present invention, Accordingly, the appended claims are intended to include within their scope such processes, machines, manufacture, compositions of matter, means, methods, or steps.

What is claimed is:

1. A method of transceiving an audio signal, the method comprising:

providing low band spectral information comprising a plurality of spectrum coefficients;

predicting a high band extended spectral fine structure from the low band spectral information for at least one subband, the high band extended spectral fine structure comprising a plurality of spectrum coefficients, wherein predicting comprises preparing the spectrum coefficients of the low band spectral information, defining prediction parameters for the high band extended spectral fine structure and index ranges of the prediction parameters, and determining possible best indices of the prediction parameters, determining comprising minimizing a prediction error between a reference subband in high band and a predicted subband that is selected and composed from an available low band, wherein the steps of preparing, defining and determining are performed using a hardware-based audio encoder; and transmitting the possible best indices of the prediction parameters.

2. The method of claim 1, wherein the prediction parameters comprise prediction lag and sign.

3. The method of claim 1, wherein predicting comprises intra frame frequency predicting.

4. The method of claim 1, wherein the available low band is modified before predicting if a modification is performed in both an encoder and a decoder.

5. The method of claim 1, wherein minimizing the prediction error comprises minimizing the expression:

$$\text{Err_F}(k'_p, \text{sign}) = \sum_k \left[\text{sign}\cdot\hat{S}_{LB}(k+k'_p) - S_{ref}(k)\right]^2$$

by selecting best $k'_p$ and sign, wherein $k'_p$ and sign comprise prediction parameters, $k'_p$ comprises a prediction lag, sign comprises a value of either 1 or −1, $S_{ref}(\cdot)$ comprises reference coefficients of a reference subband representing ideal spectrum coefficients, and $\hat{S}_{LB}(\cdot)$ represents the available low band.

6. The method of claim 5, wherein minimizing the prediction error further comprises maximizing the expression:

$$\text{Max}\left\{\frac{\left[\sum_k \hat{S}_{LB}(k+k'_p)\cdot S_{ref}(k)\right]^2}{\sum_k \left[\hat{S}_{LB}(k+k'_p)\right]^2}, \text{ for possible } k'_p\right\}$$

by selecting best $k'_p$ and sign, wherein sign is determined by the expression:

$$\text{If} \quad \sum_k \hat{S}_{LB}(k+k'_p)\cdot S_{ref}(k) \quad >= 0, \quad \text{sign} = 1;$$

$$\text{else} \qquad \text{sign} = -1.$$

7. The method of claim 1, further comprising receiving the possible best indices of the prediction parameters.

8. The method of claim 7, wherein an extended spectral fine structure of the at least one subband in high band is produced from the received possible best indices of the prediction parameters according to the expression:

$$\hat{S}_p(k)=\hat{S}_{HB}(k)=S_{BWE}(k)=S_h(k)=\text{sign}\cdot\hat{S}_{LB}(k+k'_p)$$

wherein $k_p'$ and sign comprise prediction parameters, $k_p'$ comprises a prediction lag, sign comprises a value of either 1 or −1, $\hat{S}_{LB}(\cdot)$ represents the available low band, and $\hat{S}_p(\cdot)=\hat{S}_{HB}(\cdot)=S_{BWE}(\cdot)=S_h(\cdot)$ comprises a predicted portion of said extended subband.

9. The method of claim 8, further comprising scaling a final energy of each predicted subband in the high band based on received spectral envelope information.

10. The method of claim 1, wherein transmitting is performed with a limited bit budget.

11. The method of claim 1, wherein transmitting comprises transmitting the possible best indices of the prediction parameters over a voice over internet protocol (VOIP) network.

12. The method of claim 1, wherein transmitting comprises transmitting the possible best indices of the prediction parameters over a voice over a mobile telephone network.

13. The method of claim 1, further comprising receiving an audio signal and converting the audio signal to the low band spectral information.

14. The method of claim 13, wherein receiving an audio signal comprises receiving a speech signal from a microphone.

15. The method of claim 1, wherein predicting is performed in a log, linear or weighted domain.

16. The method of claim 1, wherein using the hardware-based audio encoder comprises performing the steps of preparing, defining and determining using a processor.

17. The method of claim 1, wherein using the hardware-based audio encoder comprises performing the steps of preparing, defining and determining using dedicated hardware.

18. A system for transmitting an audio signal, the system comprising:

a transmitter comprising a hardware-based audio coder, the hardware-based audio coder configured to:

convert the audio signal to low band spectral information comprising a plurality of spectrum coefficients, predict a high band extended spectral fine structure from the low band spectral information for at least one subband, the high band extended spectral fine structure comprising a plurality of spectrum coefficients, prepare the spectrum coefficients of the low band spectral information, define prediction parameters for the high band extended spectral fine structure and index ranges of the prediction parameters, determine possible best indices of the prediction parameters, wherein a prediction error is minimized between a reference subband in high band and a predicted subband that is selected and composed from an available low band, and produce an encoded audio signal comprising the possible best indices of the prediction parameters;

wherein, the transmitter is configured to transmit the encoded audio signal.

19. The system of claim 18, wherein the transmitter is configured to operate over a voice over internet protocol (VOW) system.

20. The system of claim 18, wherein the transmitter is configured to operate over a cellular telephone network.

21. The system of claim 18, further comprising a receiver configured to receive the encoded audio signal, the receiver comprising a decoder configured to produce an extended fine structure of the at least one subband based on received possible best indices of the prediction parameters.

22. The system of claim 18, wherein the hardware-based audio coder comprises a processor.

23. The system of claim 18, wherein the hardware-based audio coder comprises dedicated hardware.

* * * * *

UNITED STATES PATENT AND TRADEMARK OFFICE

CERTIFICATE OF CORRECTION

PATENT NO. : 8,532,983 B2
APPLICATION NO. : 12/554619
DATED : September 10, 2013
INVENTOR(S) : Yang Gao It is certified that error appears in the above-identified patent and that said Letters Patent is hereby corrected as shown below:

In the Specification

In Col. 2, line 20, Background – G729.1 Encoder, delete "$s_{LB}^{qmf}(n)$" and insert -- $s_{LB}^{qmf}(n)$--.

In Col. 2, line 31, Background – G729.1 Encoder, delete "$d_{LB}^{w}(n)$" and insert -- $d_{LB}^{w}(n)$--.

In Col. 2, line 33, Background – G729.1 Encoder, delete "$d_{LB}^{w}(n)$" and insert -- $d_{LB}^{w}(n)$--.

In Col. 2, line 35, Background – G729.1 Encoder, delete "$s_{HB}^{fold}(n)$" and insert -- $s_{HB}^{fold}(n)$--.

In Col. 2, line 40, Background – G729.1 Encoder, delete "$D_{LB}^{w}(k)$" and insert -- $D_{LB}^{w}(k)$--.

In Col. 2, line 65, Background – TDBWE Encoder, after "(2ms)" insert --and--.

In Col. 3, line 14, Background – G729.1 Decoder, delete "$\hat{s}_{LB}^{post}(n)$" and insert -- $\hat{s}_{LB}^{post}(n)$--.

In Col. 3, lines 15-16, Background – G729.1 Decoder, delete "$\hat{s}_{LB}^{qmf}(n) = \hat{s}_{LB}^{hpf}(n)$" and insert -- $\hat{s}_{LB}^{qmf}(n) = \hat{s}_{LB}^{hpf}(n)$--.

In Col. 3, line 18, Background – G729.1 Decoder, delete "$\hat{s}_{HB}^{qmf}(n)$" and insert -- $\hat{s}_{HB}^{qmf}(n)$--.

In Col. 3, line 22, Background – G729.1 Decoder, delete "$\hat{s}_{LB}^{post}(n)$" and insert -- $\hat{s}_{LB}^{post}(n)$--.

In Col. 3, line 23, Background – G729.1 Decoder, delete "$\hat{s}_{LB}^{qmf}(n) = \hat{s}_{LB}^{hpf}(n)$" and insert -- $\hat{s}_{LB}^{qmf}(n) = \hat{s}_{LB}^{hpf}(n)$--.

In Col. 3, line 25, Background – G729.1 Decoder, delete "$\hat{s}_{HB}^{qmf}(n)$" and insert -- $\hat{s}_{HB}^{qmf}(n)$--.

In Col. 3, line 29, Background – G729.1 Decoder, delete "$\hat{s}_{HB}^{bwe}(n)$" and insert -- $\hat{s}_{HB}^{bwe}(n)$--.

In Col. 3, line 32, Background – G729.1 Decoder, delete "$\hat{S}_{HB}^{bwe}(k)$" and insert -- $\hat{S}_{HB}^{bwe}(k)$--.

In Col. 3, line 36, Background – G729.1 Decoder, delete "$\hat{s}_{HB}^{qmf}(n)$" and insert -- $\hat{s}_{HB}^{qmf}(n)$--.

In Col. 3, line 37, Background – G729.1 Decoder, delete "$\hat{s}_{LB}^{qmf}(n) = \hat{s}_{LB}^{post}(n)$" and insert -- $\hat{s}_{LB}^{qmf}(n) = \hat{s}_{LB}^{post}(n)$--.

Signed and Sealed this
Seventh Day of January, 2014

Margaret A. Focarino

Margaret A. Focarino
*Commissioner for Patents of the United States Patent and Trademark Office*

In Col. 3, line 41, Background – G729.1 Decoder, delete "$\hat{D}_{LB}^{w}(k)$" and insert -- $\hat{D}_{LB}^{w}(k)$ --.

In Col. 3, line 48, Background – G729.1 Decoder, delete "$\hat{S}_{HB}^{bwe}(k)$. Both $\hat{D}_{LB}^{w}(k)$" and insert -- $\hat{S}_{HB}^{bwe}(k)$. Both $\hat{D}_{LB}^{w}(k)$ --.

In Col. 3, line 50, Background – G729.1 Decoder, delete "$\hat{d}_{LB}^{w}(n)$" and insert -- $\hat{d}_{LB}^{w}(n)$ --.

In Col. 3, line 56, Background – G729.1 Encoder, delete "$\hat{s}_{HB}^{fold}(n)$" and insert -- $\hat{s}_{HB}^{fold}(n)$ --.

In Col. 3, line 57, Background – G729.1 Decoder, delete "$\hat{s}_{LB}^{qmf}(n) = \hat{s}_{LB}^{post}(n)$ and $\hat{s}_{HB}^{qmf}(n)$" and insert -- $\hat{s}_{LB}^{qmf}(n) = \hat{s}_{LB}^{post}(n)$ and $\hat{s}_{HB}^{qmf}(n)$ --.

In Col. 3, line 64, Background – TDBWE Decoder, delete "$\hat{s}_{HB}^{exc}(n)$" and insert -- $\hat{s}_{HB}^{exc}(n)$ --.

In Col. 4, lines 63 – 64, Background – TDBWE Decoder, delete "$g_v = \sqrt{\frac{1}{2}\left(g'^{2}_{v} + g'^{2}_{v,old}\right)}$" and insert -- $g_v = \sqrt{\frac{1}{2}\left(g'^{2}_{v} + g'^{2}_{v,old}\right)}$ --.

In Col. 5, line 1, Background – TDBWE Decoder, delete "$g_v^2 + g_{nv}^2 = 1$" and insert -- $g_v^2 + g_{nv}^2 = 1$ --.

In Col. 5, line 31, Background – TDBWE Decoder, delete "$s_{HB}^{exc}(n)$" and insert -- $s_{HB}^{exc}(n)$ --.

In Col. 5, line 37, Background – TDBWE Decoder, delete "$s_{HB}^{exc}(n)$" and insert -- $s_{HB}^{exc}(n)$ --.

In Col. 5, line 37, Background – TDBWE Decoder, delete "$s_{HB}^{exc}(n)$" and insert -- $s_{HB}^{exc}(n)$ --.

In Col. 5, line 38, Background – TDBWE Decoder, delete "$\hat{s}_{HB}^{T}(n)$" and insert -- $\hat{s}_{HB}^{T}(n)$ --.

In Col. 5, line 42, Background – TDBWE Decoder, delete "$s_{HB}^{exc}(n)$" and insert -- $s_{HB}^{exc}(n)$ --.

In Col. 5, line 43, Background – TDBWE Decoder, delete "$s_{HB}^{exc}(n)$" and insert -- $s_{HB}^{exc}(n)$ --.

In Col. 5, line 46, Background – TDBWE Decoder, delete "$s_{HB}^{exc}(n)$" and insert -- $s_{HB}^{exc}(n)$ --.

In Col. 5, line 48, Background – TDBWE Decoder, delete "$s_{HB}^{exc}(n)$" and insert -- $s_{HB}^{exc}(n)$ --.

In Col. 5, line 58, Background – TDBWE Decoder, delete "$\hat{s}_{HB}^{T}(n)$" and insert -- $\hat{s}_{HB}^{T}(n)$ --.

In Col. 6, line 4, Background – TDBWE Decoder, delete "$\hat{s}_{HB}^{F}(n)$" and insert -- $\hat{s}_{HB}^{F}(n)$ --.

In Col. 6, line 6, Background – TDBWE Decoder, delete "$s_{HB}^{exc}(n)$" and insert -- $s_{HB}^{exc}(n)$ --.

In Col. 6, line 10, Background – TDBWE Decoder, delete "$\hat{s}_{HB}^{F}(n)$" and insert -- $\hat{s}_{HB}^{F}(n)$ --.

In Col. 6, line 11, Background – TDBWE Decoder, delete "$\hat{s}_{HB}^{F}(n)$. Each sample of $\hat{s}_{HB}^{F}$" and insert -- $\hat{s}_{HB}^{F}(n)$. Each sample of $\hat{s}_{HB}^{F}$ --.

In Col. 6, line 13, Background – TDBWE Decoder, delete "$\hat{s}_{HB}^{F}(n)$" and insert -- $\hat{s}_{HB}^{F}(n)$ --.

In Col. 6, line 16, Background – TDBWE Decoder, delete "$\hat{s}_{HB}^{bwe}(n)$" and insert -- $\hat{s}_{HB}^{bwe}(n)$ --.

In Col. 6, line 25, Background – The SBR Principle, delete "en coding" and insert --encoding--.

In Col. 13, line 21, Detailed Description of Illustrative Embodiments, delete "$\hat{S}_p(k) = sign \cdot \hat{S}_{wb}(k + 280 - k_p$" and insert -- $\hat{S}_p(k) = sign \cdot \hat{S}_{wb}(k + 280 - k_p)$ --.

In the Claims

In Col. 17, line 49, claim 8, after "wherein", delete "$k_p'$" and insert -- $k'_p$ --.

In Col. 17, line 49, claim 8, after "parameters", delete "$k_p'$" and insert -- $k'_p$ --.

In Col. 18, line 46, claim 19, delete "(VOW) system" and insert --(VOIP) system--.